United States Patent [19]

Theis

[11] Patent Number: 4,565,132

[45] Date of Patent: Jan. 21, 1986

[54] FORM-LOCKING MEANS, MATERIAL FOR FORMING SAME AND PROCESS FOR ARRANGING THE FORM-LOCKING MEANS IN THE PERIPHERAL REGION OF A PROJECTILE MADE OUT OF THE HEAVY METAL SINTER ALLOY

[75] Inventor: Ulrich Theis, Mülheim, Fed. Rep. of Germany

[73] Assignee: Rheinmetall GmbH., Duesseldorf, Fed. Rep. of Germany

[21] Appl. No.: 291,825

[22] Filed: Aug. 10, 1981

[30] Foreign Application Priority Data

Aug. 9, 1980 [DE] Fed. Rep. of Germany ..... 3030072

[51] Int. Cl.[4] ..... F42B 11/00; F42B 13/16

[52] U.S. Cl. ..... 102/517; 102/520

[58] Field of Search ..... 102/501, 517–528; 419/8; 428/553, 548, 558, 559

[56] References Cited

U.S. PATENT DOCUMENTS 3,620,167 11/1971 Romer et al. ..... 102/521
3,946,673 3/1976 Hayes ..... 102/517
3,979,234 9/1976 Northcutt, Jr. et al. ..... 419/29
4,381,319 4/1983 Hargreaves et al. ..... 102/527

OTHER PUBLICATIONS

Verformungs-und Mikrobruchverhalten von 2 phasigen mit fluessiger Phase gesinterten Wolfram-Verbundwerkstoffen by Dr. Erwin J. Votava.

*Primary Examiner*—Harold J. Tudor

[57] ABSTRACT

Form-locking means and process for joining same to a sub-caliber projectile in a peripheral region thereof.

The form-locking means consist of a material in the form of an n-phase sinter alloy having a high content of at least one heavy metal, where n≧2. The material forming the form-locking means in the peripheral region of the sub-caliber projectile form at least one further alloy phase. The form-locking means are joined to the periphery of the sub-caliber projectile in the form of a layer of predetermined thickness which can be joined to the projectile surface by recasting with a melt of the form-locking material or by flame-spraying such layer on the projectile surface.

4 Claims, 1 Drawing Figure

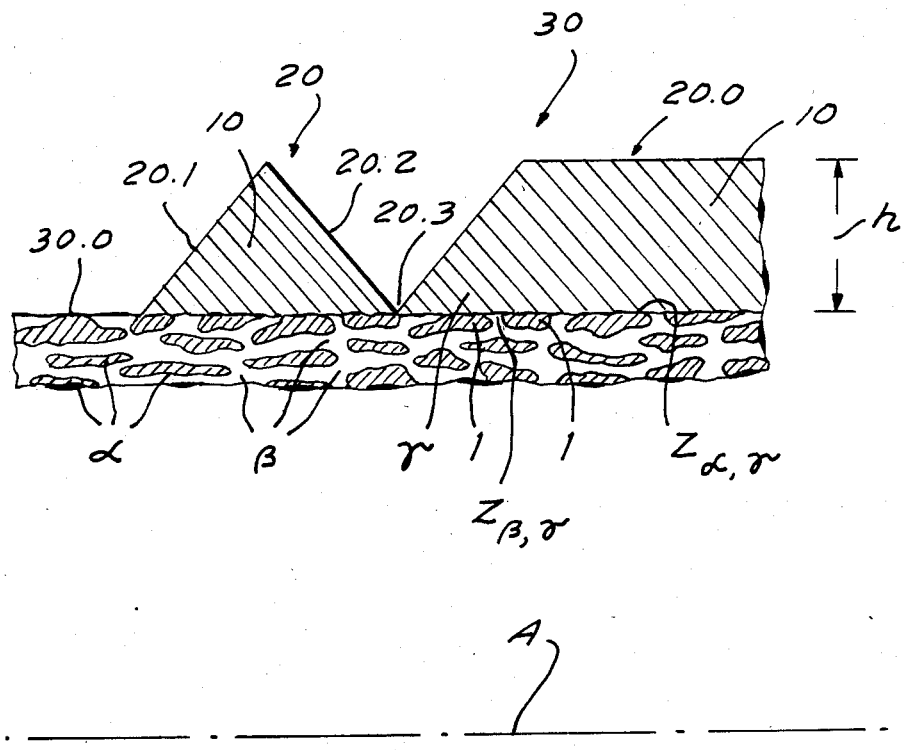
30
20
20.0
10
10
20.1
20.2
20.3
30.0
h
α
β
γ
1
1
$Z_{\alpha,\gamma}$
$Z_{\beta,\gamma}$
A

FORM-LOCKING MEANS, MATERIAL FOR FORMING SAME AND PROCESS FOR ARRANGING THE FORM-LOCKING MEANS IN THE PERIPHERAL REGION OF A PROJECTILE MADE OUT OF THE HEAVY METAL SINTER ALLOY

Subcaliber projectiles serve to combat armored targets by means of inertial forces inherent in the projectile in flight. It is of course understood that the product of the mass and the impacting velocity and the density of the impacting projectile plays a particularly important role as far as target penetrating effectiveness is concerned. Heretofore there have been used materials of high density for such projectiles, which materials are in the form of sinter-alloys having a high percentage content of a heavy metal, preferably tungsten. A projectile of the afore-described type must be provided with form-locking means in order to join the projective body with the sabot (which is to be separated from the projectile) in a predetermined peripheral region.

Such a form locking means may, for example, be in the form of a threaded joint or in the form of interdigitating grooves and projections. Such form-locking means are already disclosed in D.E.-O.S. (West German published application No.) 1703507. Such form-locking means can, in a disadvantageous manner, produce undesirable fatigue-stress concentrations in the projectile.

In D.E.-P.S. (West Germany Pat. No.) 1428679 there is disclosed a projectile, whose cover is made out of a high-grade steel and has heavy metal cores. If such cover or casing is provided with a threaded portion, then the core thereof can be maintained free of the undesirable fatigue-stress-concentrations. However, in order to achieve this, sufficient wall thickness must be provided, which in turn negatively influences the target-effective specific density of the projectile.

SUMMARY OF THE INVENTION

The invention has as an object to provide form-locking means on a projectile in which the undesirable stress concentration factors are avoided or mitigated.

By judicially selecting material for the form-locking means there is furthermore advantageously obtained that the target effective specific density of the projectile is not negatively influenced. The form-locking means material is, at target penetration, due to the mutual contacting between the material of the target with that of the projectile, "smeared" over the projectile surface, and therefore only negligibly hinders the penetration of the projectile. This is particularly advantageous in order to assure a high "target effectiveness" when combatting multi-armored targets.

By means of the process for arranging the form-locking means in accordance with the invention there is advantageously provided a secure joint with little energy and material input while at the same time avoiding impairment of the sinter structure due to the influence of temperature and heat.

Finally, the process of the invention also provides advantageously that the working input for producing the form-locking means is relatively small.

BRIEF DESCRIPTION OF THE DRAWINGS

With these and other objects in view, which will become apparent in the following detailed description, the present invention will be clearly understood in connection with the accompanying single FIGURE of the drawing where there is illustrated schematically a partial region of the periphery of the projectile having the form-locking means all of which are illustrated in section parallel to the longitudinal axis of the projectile.

DETAILED DESCRIPTION

In the peripheral region 30 of a projectile which is not illustrated in detail (having an arbitrarily illustrated longitudinal axis A,) consisting of an n-phase sinter-alloy having a high tungsten content which includes in addition to phase $\alpha$ (tungsten) and $\beta$ (iron-nickel) of the sinter-alloy a further phase $\gamma$. The phase $\gamma$ is coordinated with an aluminum alloy 10, which in the peripheral region 30 is affixed, via a layer 20.0 having the thickness h, on the peripheral surface 30.0. In the left portion 30.0 of the projectile cover there is already cut a threaded part formed as a form-locking means 20 having flanks 20.1 and 20.2 and a throat 20.3 of the threaded part, all which are cut out of the layer 20.0. Between, for example, two adjacent observed tungsten grains 1 the exterior bounday of the phase $\alpha$ has a depression, which is filled in by the phase $\beta$, so that one can speak of an "anchoring" of the material 10 in the sintered body. This is recognizable from the position of the phase boundary $Z_{\alpha,\gamma}$ with respect to the phase boundary $Z_{\beta,\gamma}$. In the aforedescribed two-phase-sinter-alloy an iron-nickel-alloy forms the binding medium for the tungsten grains of the phases with $\alpha$ and $\beta$. Selection of the material 10 results under observation of following conditions: It must have sufficient strength properties and at firing must furnish a reliable form-locking between the sabot and the projectile; it must be simple to work this material 10; it must have an acceptable work input and be capable of being affixed in such a way that disturbances in the sinter structure, due to overheating, are avoided. It has been ascertained, that, for example, light metal alloys having a preponderance of magnesium or aluminum content, can be used. With such components a relatively low melting temperature is inherent. With such alloys a cold working or heat treatment can impart thereto the required strength properties. Moreover, the alloy metals can, with little work input, be affixed as a layer with the required thickness or can be affixed already preponderently in final desired form, that is, for example, as a threaded bandage portion. As a process for affixing there can, for example, be used pressure casting (utilizing the expansion of the selected material whereby particularly suitable alloys are selected) and flame spraying.

By selecting a softening region of the corresponding material 10 having a comparatively low melt temperature the following advantages are rendered: at the latest at target penetration the material can be "smeared" in view of the resulting heat formation and sufficiently high temperature build up which causes it to lose consistency and strength and the material is literally "smeared", so that only the cross-sectional surface of the singer body, which has a high density, becomes "target effective". This has been found to be particularly advantageous with multi-plated armored targets.

I claim:

1. Form-locking means in a peripheral surface region 30 of a subcaliber projectile for form-locking the projectile to a sabot, said surface region consists of a material in the form of an n-phase sinter alloy, said alloy having a high density due to having a high content of at least one heavy metal, where $n \geqq 2$, said n-phase sinter alloy of said form-locking means forming in said peripheral surface region 30 of the projectile at least one further alloy phase including a predetermined amount of a light metal.

2. The form-locking means as set forth in claim 1, wherein said heavy metal is tungsten.

3. The form-locking means as set forth in claim 1, wherein said light metal is aluminum.

4. The form-locking means as set forth in claim 3, wherein said light metal is magnesium.

* * * * *